US007682326B2

(12) United States Patent
Song

(10) Patent No.: US 7,682,326 B2
(45) Date of Patent: Mar. 23, 2010

(54) FOOT PROTECTION DEVICE FOR A FIGHT

(75) Inventor: Dong-Suk Song, Chungcheongnam-do (KR)

(73) Assignee: Han Ji Corporation, Los Angeles, CA (US)

( * ) Notice: Subject to any disclaimer, the term of this patent is extended or adjusted under 35 U.S.C. 154(b) by 775 days.

(21) Appl. No.: 10/563,164

(22) PCT Filed: Jun. 25, 2004

(86) PCT No.: PCT/KR2004/001547

§ 371 (c)(1),
(2), (4) Date: Dec. 27, 2005

(87) PCT Pub. No.: WO2005/000049

PCT Pub. Date: Jan. 6, 2005

(65) Prior Publication Data

US 2006/0137224 A1 Jun. 29, 2006

(30) Foreign Application Priority Data

Jun. 27, 2003 (KR) ..... 20-2003-0020516 U
Jun. 23, 2004 (KR) ..... 20-2004-0017787 U

(51) Int. Cl.
*A61F 13/00* (2006.01)

(52) U.S. Cl. ..... 602/60; 2/239

(58) Field of Classification Search ..... 602/60, 602/66, 27, 30, 28, 29, 62, 65, 63; 2/239, 2/22; 36/94; 128/882; 66/178 R, 183
See application file for complete search history.

(56) References Cited

U.S. PATENT DOCUMENTS 4,021,860 A * 5/1977 Swallow et al. ..... 2/239
4,651,354 A * 3/1987 Petrey ..... 2/239
4,972,609 A * 11/1990 Oh et al. ..... 36/2 R
5,211,672 A * 5/1993 Andujar ..... 36/106
5,412,957 A * 5/1995 Bradberry et al. ..... 66/178 A
5,682,617 A * 11/1997 Tumas ..... 2/239
5,774,898 A * 7/1998 Malpee ..... 2/239
5,899,872 A * 5/1999 Gilmour ..... 602/65
6,234,988 B1 * 5/2001 Brother et al. ..... 602/65
7,107,626 B1 * 9/2006 Andrews ..... 2/239

* cited by examiner

*Primary Examiner*—Patricia Bianco
*Assistant Examiner*—James M Robinson
(74) *Attorney, Agent, or Firm*—Lee, Hong, Degerman, Kang & Waimey

(57) ABSTRACT

Disclosed herein is a foot protection device adapted to protect feet when training and playing fighting games. The device includes an exterior cover (100). The exterior cover has an opening (10), an anterior hole (20) and a posterior hole (30) provided on a sole portion (A), toe insert parts (40) provided on a toe portion (B) and having toe holes (45), and an ankle securing means (150) provided at an end of an ankle portion (C). The device protects a wearer's feet, and is in maximally close contact with the feet due to its elastic force, and is light in weight, thus providing a sensation similar to that of a barefoot state. Further, a part of the foot is exposed to the outside, thus preventing the wearer from sliding on the ground surface, and allowing free movement of the foot, therefore affording a high level of power and quickness.

16 Claims, 8 Drawing Sheets

FOOT PROTECTION DEVICE FOR A FIGHT

CROSS-REFERENCE TO RELATED APPLICATIONS

This application is a 371 U.S. national stage application of international application PCT/KR04/01547, filed on Jun. 25, 2004, which claims priority of Korean patent applications 20-2003-0020516, filed on Jun. 27, 2003 and 20-2004-0017787, filed on Jun. 23, 2004, the contents of which are hereby incorporated by reference herein in their entirety.

TECHNICAL FIELD

The present invention relates to foot protection devices adapted to protect players' feet when training and playing fighting games, such as Taekwondo. More particularly, the present invention relates to a foot protection device for fighting games, which includes an elastic exterior cover designed to expose a part of the foot to the outside, thus allowing a wearer to move his/her foot as freely as though there were nothing on the foot, preventing the wearer from sliding on a ground surface and thereby affording a high level of power and quickness.

BACKGROUND ART

Generally, fighting games such as kick boxing, Karate, Kungfu, Judo, Taekwondo and the like typically comprise hand skills and foot skills. Especially the foot skills are advantageous in attacking opponents and more intimidating attacks can be made by use of the foot skills. For this reason, the foot skills have advanced much more than the hand skills. Developing foot skills requires a large amount of trainings.

In playing fighting games including Taekwondo, players wear uniforms and protective equipment to protect their bodies, but they do not wear socks on their feet. That is, players generally train and play games barefoot. If they wear socks, they are highly likely to slip. When they wear shoes, attacks may injure their opponents. But, most of all, they cannot precisely assume desirable postures when they wear socks or shoes, and thus, it is general for the players to train and play games in their bare feet. However, frequent wounds are caused when they play barefoot.

For example, the foot kicking skills in Taekwondo are classified into forward kicking, side kicking, and backward kicking. Especially, among side kicking skills, forward turning kicking skill whereby a side of the opponent is hit by use of the top of the foot is one of the attack skills used most frequently in actual games. At this time, the opponent has to defend against the forward turning kicks by using his/her arm to block the kick. In this event, the top of the foot of the player having attacked with the forward turning kick is frequently damaged or hurt with swelling, contusion and so on because it heavily collides with the opponent's elbow. In addition, forward kicking aims to hit the full face of the opponent, and forward turning kicking aims to attack the side of the opponent by use of the anterior area or the top area of the player's foot. In this event, such injuries as spraining of toes are frequently generated because of collision with the opponent's hands or feet. Further, this kind of injury most often occurs immediately before important games for which the players have spent a large amount of time training. Thus, the players would not demonstrate their skills fully in actual games or in the worst case they would give up the games.

There have been developed various protection devices to protect a player's arms and legs. However, a foot protection device for protecting the player's feet has not been satisfactorily developed yet. Therefore, Taekwondo footwear manufactured to be lighter in weight than general footwear has been used as the foot protection device. The Taekwondo footwear is shown in FIG. 1.

As shown in FIG. 1, the conventional foot protection device, that is, the Taekwondo footwear 1 includes an exterior upper 2 to cover a foot, an outsole 3 which is made of a rubber material and attached to a bottom of the exterior upper 2, and a cover 4 provided on an instep portion of the exterior upper 2.

However, the Taekwondo footwear 1 has a problem in that it cannot sufficiently protect the top area of the foot against the effect of a large blow delivered by an opponent. In order to solve the problem, Korean U.M. Registration No. 20-0199704 proposed an instep protection device 5 attached to the Taekwondo footwear 1 to be used along therewith. Referring to FIG. 2, the instep protection device 5 includes a cushioning body 6 attached to the Taekwondo footwear 1 to protect an instep of a wearer. A wide band 7 is provided at a predetermined position of the cushioning body 6 to surround the wearer's ankle while coupling the cushioning body 6 to the ankle. The instep protection device 5 also includes a long band 8 to couple the cushioning body 6 to the Taekwondo footwear 1.

The conventional Taekwondo footwear 1 (see, FIG. 1) and the instep protection device 5 (see, FIG. 2) attached to the Taekwondo footwear 1 to be used therewith can protect a wearer's foot. However, the conventional Taekwondo footwear 1 and the instep protection device 5 have a problem in that an opponent may be injured due to the weight and thickness of the Taekwondo footwear and the instep protection device, as shown in the drawings. Further, the wearer cannot freely move his/her foot, especially the toes, so that it is difficult for the wearer to display a high level of power and quickness, and assume desirable and exact foot postures.

DISCLOSURE

Technical Problem

Accordingly, an object of the present invention is to provide a foot protection device, which protects a wearer's feet, thus preventing the wearer from being injured when training or playing sports, and allowing the wearer to move his/her feet as freely as though there were nothing on the feet, and preventing the wearer from sliding on a ground surface.

Another object of the present invention is to provide a foot protection device for fighting games, which is worn to be in maximally close contact with a wearer's foot, and is designed to expose areas of the foot that contact the ground surface to the outside, thus protecting the feet while ensuring free movement of the feet, and preventing the wearer from sliding on the ground surface and thereby affording a high level of power and quickness.

A further object of the present invention is to provide a foot protection device for fighting games, capable of protecting a player's instep and ankle against a large shock.

Technical Solution

In order to accomplish the above objects, the present invention provides a foot protection device for fighting games, including an exterior cover having an opening, an anterior hole and a posterior hole provided on a sole portion, toe insert parts provided on a toe portion and having toe holes, and an ankle securing means provided at an end of an ankle portion.

Areas of the sole contacting a ground surface are exposed to the outside through the anterior and posterior holes of the exterior cover, and ends of toes are exposed through the toe holes. The toes are inserted into the toe insert parts, so that the toe insert parts protect the toes while allowing free movement of the toes. The exterior cover is in close contact with the foot due to its elasticity and the ankle securing means provided at the ankle portion.

According to an aspect of this invention, a protective cover may be attached to the exterior cover. The protective cover may be attached to an instep portion or to the ankle portion. Alternatively, the protective cover may be adapted to both the instep and ankle portions. Further, a cushioning layer is provided between the exterior cover and the protective cover, or between layers of the protective cover.

Advantageous Effects

According to the present invention, a foot protection device for protecting a wearer's feet is in maximally close contact with the wearer's feet due to an elastic force of the foot protection device, and is light in weight, thus providing a sensation similar to that of a barefoot state. Further, areas of the wearer's sole contacting a ground surface are exposed to the outside, so that the exposed areas serve as an anti-slip part. Furthermore, toes are inserted into toe insert parts, thus protecting the toes and allowing the toes to freely move, therefore affording a high level of power and quickness.

Further, the present invention provides protective covers and a cushioning layer, thus sufficiently protecting a player's instep and ankle against a large shock.

BEST MODE

The present invention will be described below in detail with reference to the accompanying drawings. The drawings are provided for illustrative purposes, but are not to be construed as the limit of the present invention.

Figure 1:
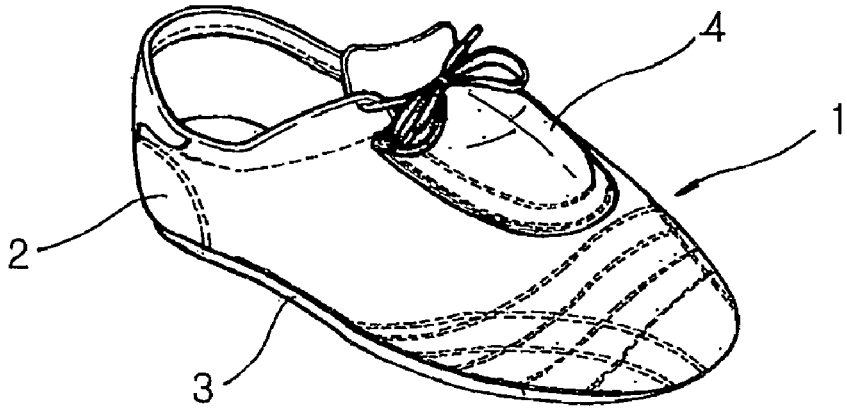
FIG. 1 (PRIOR ART)
FIG. 1 is a perspective view of prior art Taekwondo footwear for protecting feet.
Figure 2:
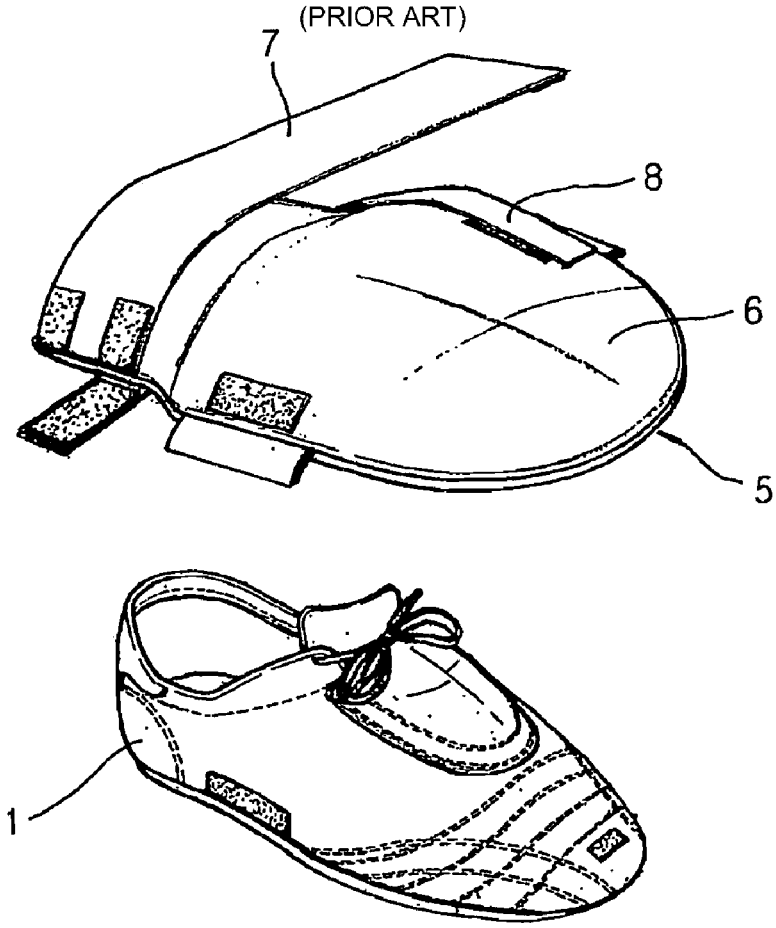
FIG. 2 (PRIOR ART)
FIG. 2 is a perspective view of a prior art instep protection device.
Figure 3:
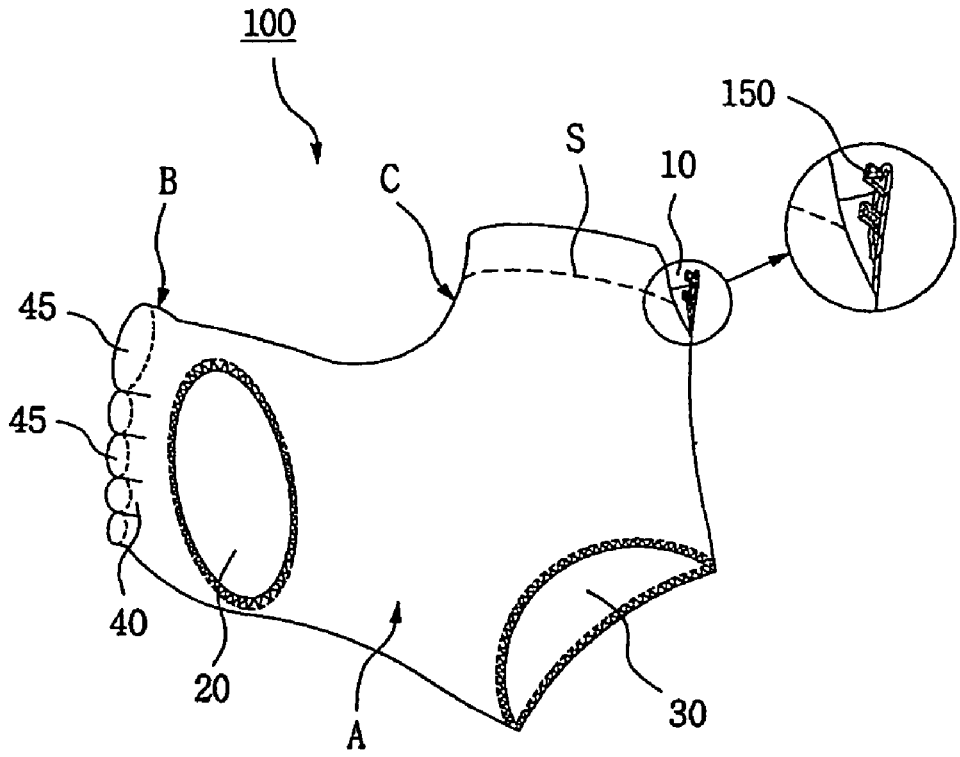
FIG. 3 is a perspective view to show a foot protection device, according to the first embodiment of the present invention, and a wearer's sole corresponding to the foot protection device.
Figure 3:
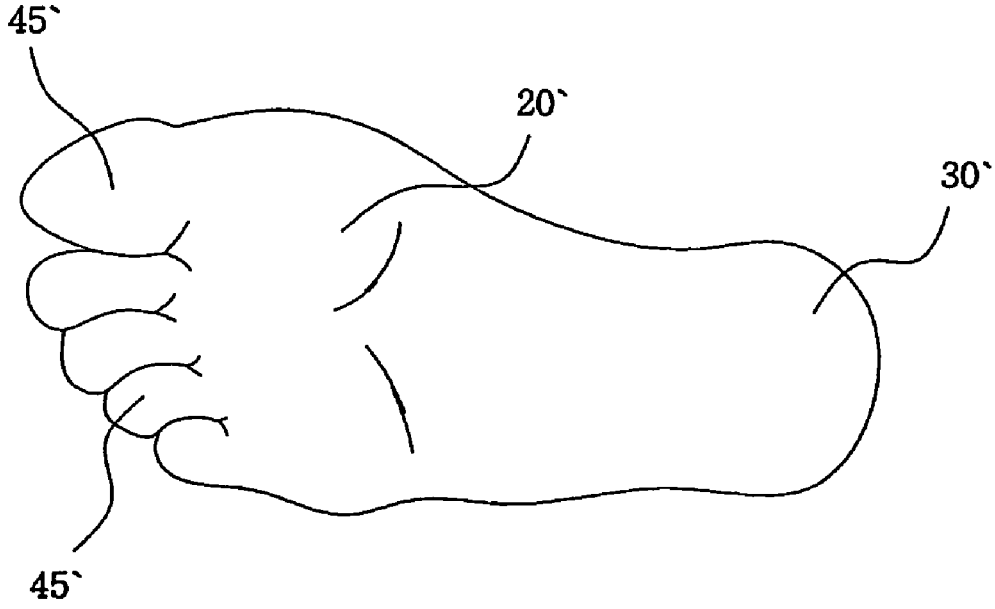
Figure 4:
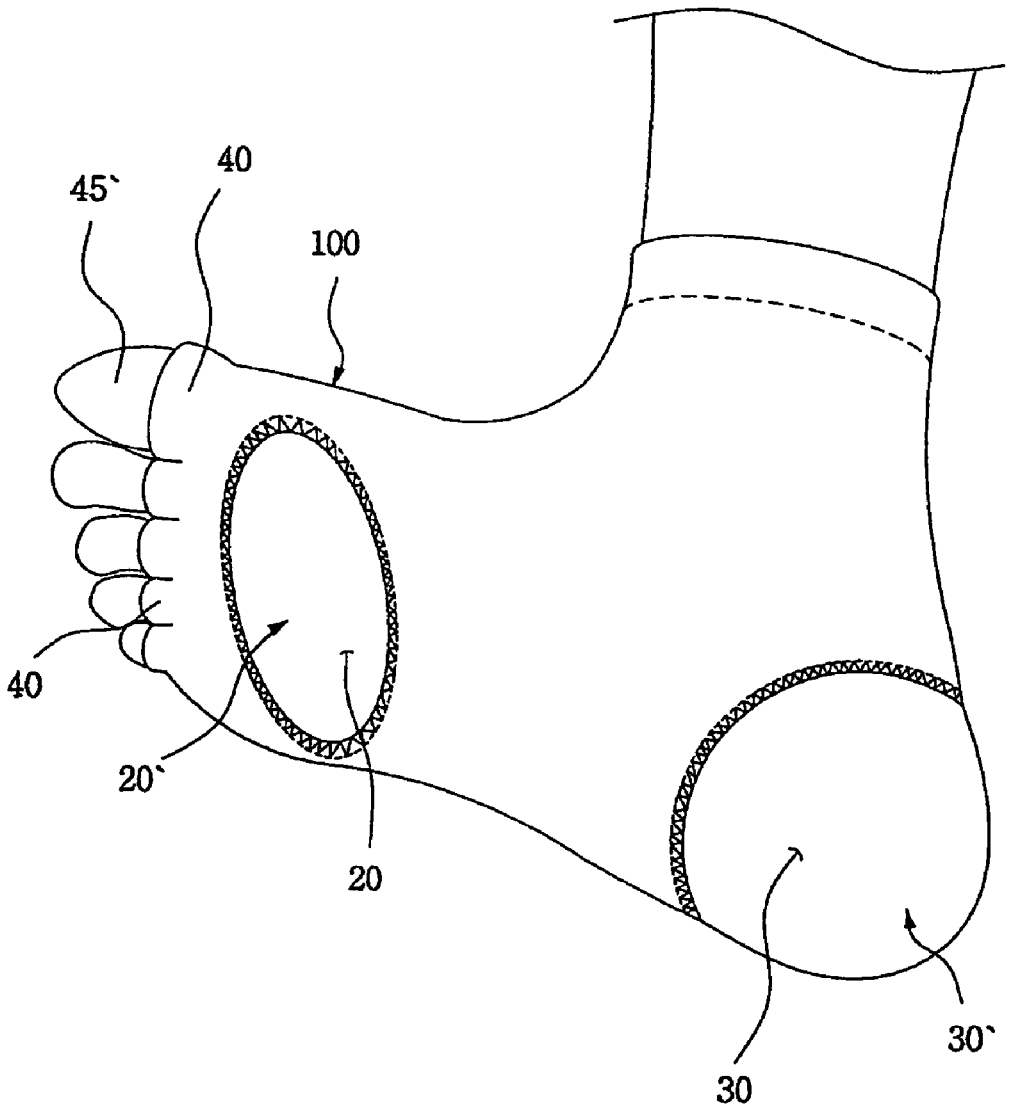
FIG. 4 is a view to show the state where the foot protection device of FIG. 3 is worn on the foot.

FIG. 3 is a perspective view to show a foot protection device, according to the first embodiment of the present invention, and a wearer's sole corresponding to the foot protection device. FIG. 4 is a view to show the state where the foot protection device of FIG. 3 is worn on the foot.

As shown in FIGS. 3 and 4, the foot protection device according to the first embodiment of this invention includes an elastic exterior cover 100.

The exterior cover 100 includes an opening 10 through which the wearer's foot is inserted. An ankle securing means 150 is provided at an end of an ankle portion C. In the present invention, the exterior cover 100 may be made of any material, as long as the material has elasticity to be in maximally close contact with the wearer's foot. For example, the exterior cover may be made of elastic fabric or non-woven fabric. Particularly, the exterior cover may be manufactured to have a shape of FIG. 3, using fabric obtained by weaving elastic fibers, such as spandex. Further, non-woven fabric fabricated in the shape of FIG. 3 to have elasticity or common toe socks may be used as the exterior cover 100. Moreover, a material having excellent sweat absorption capacity is preferred.

The exterior cover 100 is designed to have a single-fold structure or a multiple-fold structure using elastic fabric or non-woven fabric. The exterior cover 100 has a shape suitable for being worn on the foot, but has a smaller size than the foot.

The exterior cover 100 includes a sole portion A, a toe portion B, an ankle portion C, and an instep portion D to correspond to several areas of the foot. On the sole portion A are provided an anterior hole 20 and a posterior hole 30. Further, five toe insert parts 40 are provided on the toe portion B so that toes are inserted into the toe insert parts 40. A toe hole 45 is provided at an end of each of the toe insert parts 40 so that an end of each toe is exposed to the outside. Edges of the anterior hole 20, the posterior hole 30, and the toe holes 45 are closed through an overlock stitch and the like, so that the edges are not frayed.

The ankle securing means 150 functions to couple the exterior cover 100 to the wearer's ankle, and has high elasticity to make the ankle portion C of the exterior cover 100 be in maximally close contact with the wearer's ankle. The ankle securing means 150 may be fabricated in the form of an elastic band or elastic cord, using spandex, natural rubber, or synthetic rubber. When a manufacturer desires to use the elastic band, the ankle securing means 150 is attached to the ankle portion C of the exterior cover 100 through a sewing method or a bonding method by an adhesive. When a manufacturer desires to use the elastic cord, an end of the ankle portion C of the exterior cover 100 is folded to define a space, with one or more elastic cords passing through the space and then being secured in the space by a sewing method. FIG. 3 illustrates an example in which the elastic cords are used as the ankle securing means 150. The reference numeral S of FIG. 3 denotes a sewing line.

Generally, when a person stands up or rapidly changes his/her position, as shown in FIG. 4, anterior and posterior areas 20' and 30' of the sole and bottom areas 45' of the toes are in contact with the ground surface while transmitting the person's weight to the ground surface.

As such, according to the first embodiment of this invention, the exterior cover 100 includes holes at positions corresponding to the areas of the sole contacting the ground surface while transmitting the wearer's weight to the ground surface, so that the anterior and posterior areas 20' and 30' of the sole and the bottom areas 45' of the toes are exposed to the outside. In a detailed description, the anterior area 20' of the sole is exposed through the anterior hole 20 of the exterior cover 100, and the posterior area 30' of the sole is exposed through the posterior hole 30 of the exterior cover 100, and the bottom areas 45 of the toes are exposed through the toe holes 45 of the exterior cover 100.

The exterior cover 100 protects the wearer's foot, and is in maximally close contact with the wearer's foot due to its elastic force, and is light in weight, thus providing a sensation similar to that of a barefoot state. Further, the areas of the sole contacting the ground surface through the anterior hole 20, the posterior hole 30, and the toe holes 45 are exposed to the outside, so that the exposed areas serve as an anti-slip part.

Particularly, five toes are inserted into the corresponding toe insert parts 40, so that movement of the toes is free. The bottom areas 45' of the toes are exposed to the outside, thus serving as the anti-slip part and thereby affording a high level of power and quickness. Further, the toe insert parts 40 have elasticity to be in close contact with the toes, thus preventing the toes from being sprained. The toes are inserted into the toe insert parts 40 to prevent the exterior cover 100 from undesirably rotating relative to the foot, thus preventing the anterior and posterior areas 20' and 30' of the sole from being displaced from the corresponding anterior and posterior holes 20 and 30.

Figure 5:
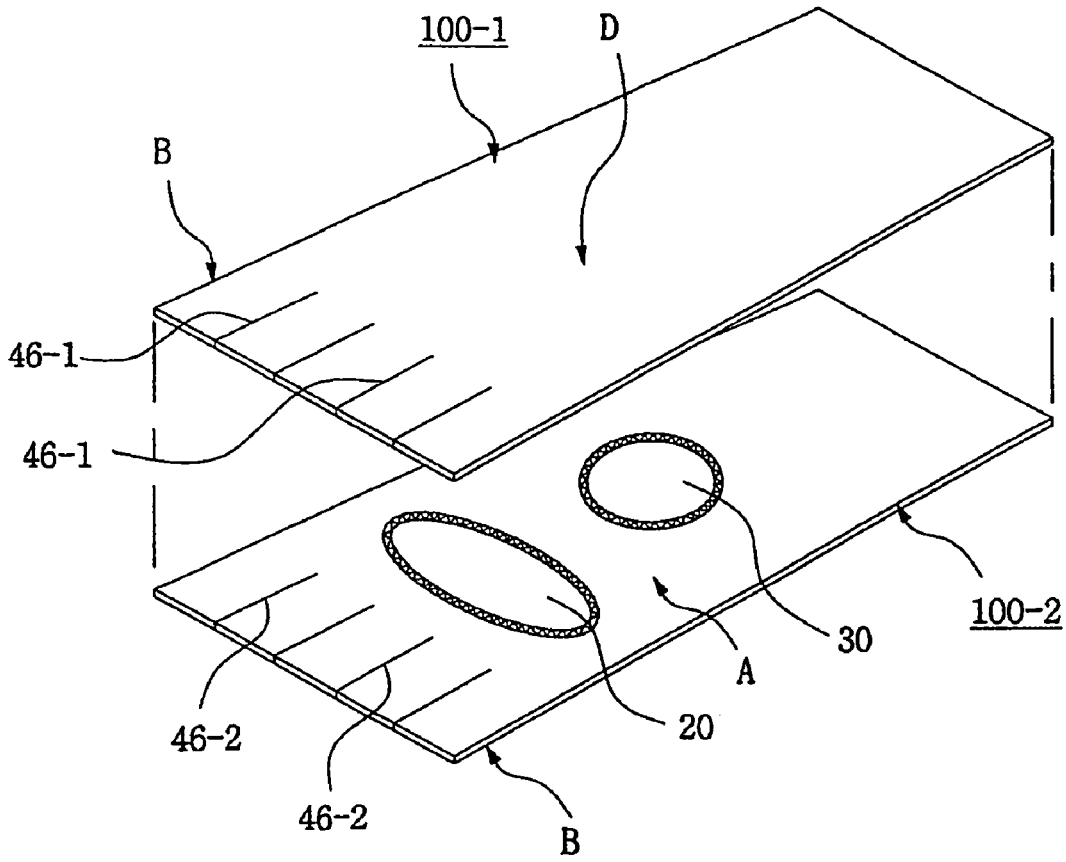
FIG. 5 is an exploded perspective view of a foot protection device, according to the second embodiment of the present invention.

FIG. 5 is an exploded perspective view of a foot protection device, according to the second embodiment of the present invention.

According to the second embodiment, the exterior cover 100 includes an upper piece 100-1 to form the instep portion D and a lower piece 100-2 to form the sole portion A. The upper and lower pieces 100-1 and 100-2 are joined together through a sewing method and the like, thus constituting the exterior cover 100. The upper piece 100-1 and lower pieces 100-2 have cut parts 46-1 and 46-2, respectively, at a position corresponding to the toe portion B. Anterior and posterior holes 20 and 30 are provided at predetermined positions of the lower piece 100-2. Thus, the upper and lower pieces 100-1 and 100-2 are joined into the exterior cover 100, and the cut parts 46-1 and 46-2 are coupled into toe insert parts 40.

As such, when the upper and lower pieces 100-1 and 100-2 are individually prepared and joined into the exterior cover 100, it is easy to make the toe insert parts 40, and it is possible to easily manufacture the exterior cover 100 using a general elastic cloth, different from the case where the upper and lower pieces 100-1 and 100-2 are integrated into a single structure.

Figure 6:
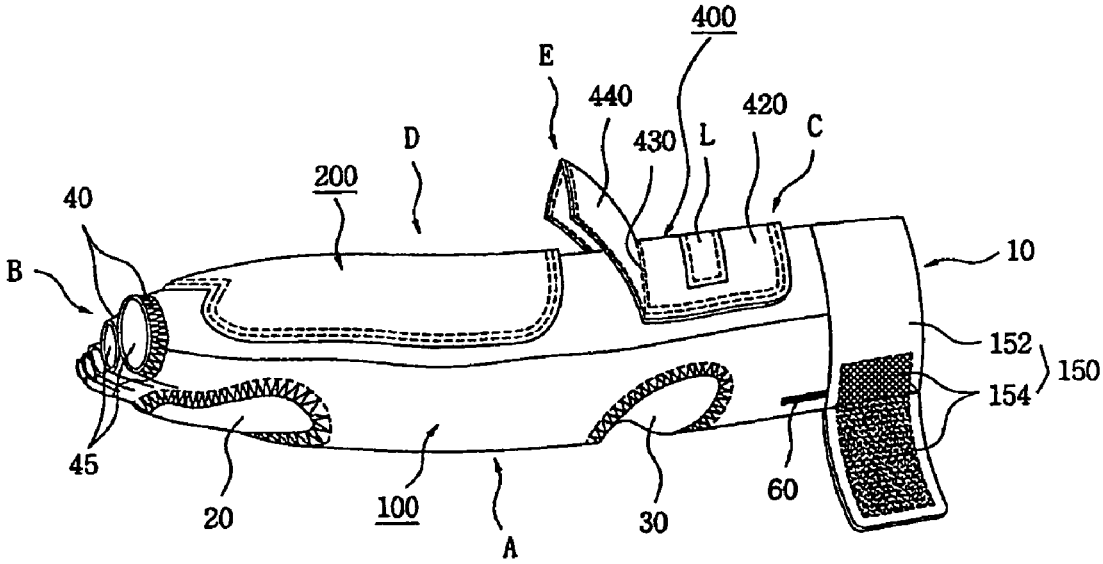
FIG. 6 is a perspective view of a foot protection device, according to the third embodiment of the present invention.
Figure 7:
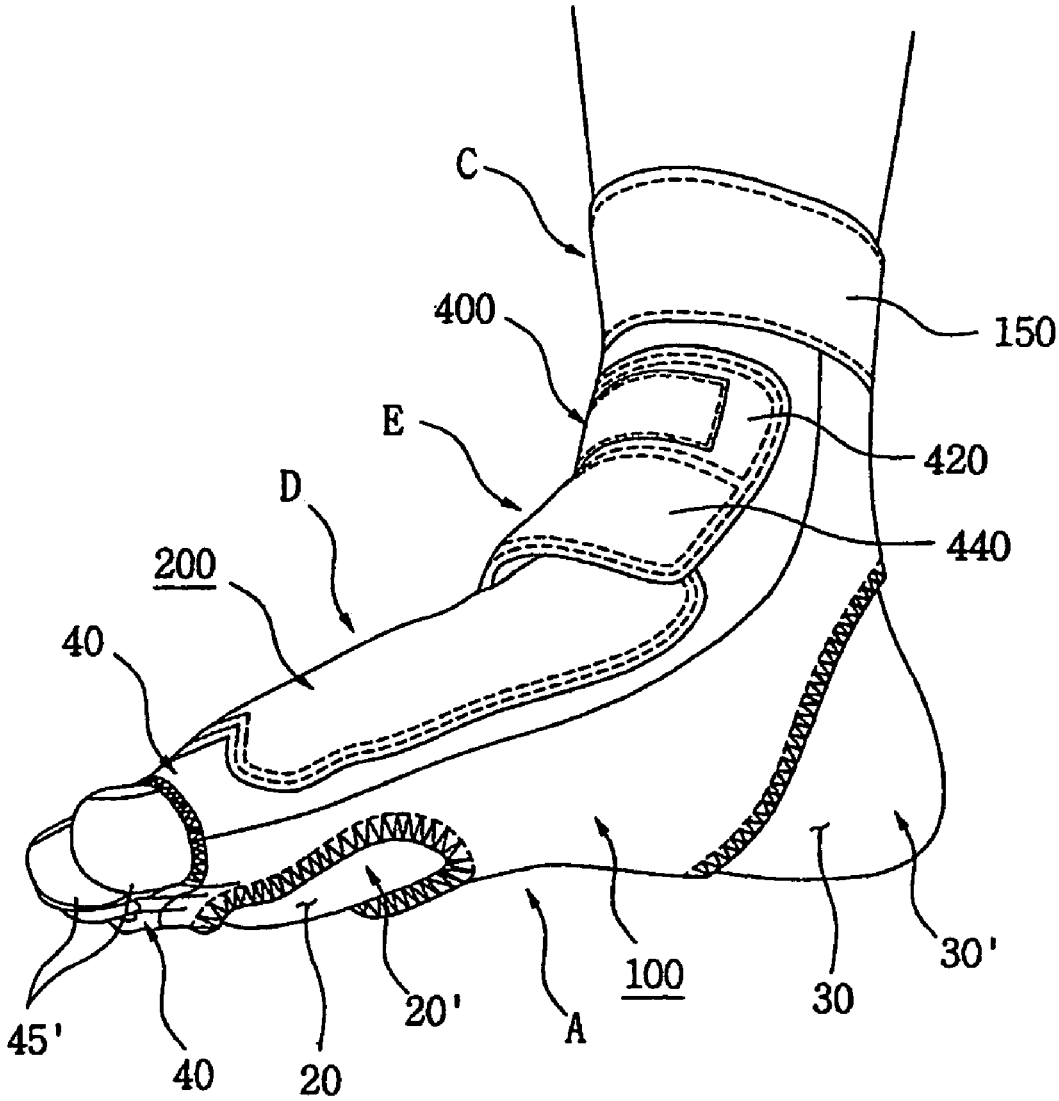
FIG. 7 is a view to show the state where the foot protection device of FIG. 6 is worn on the foot.

FIG. 6 is a perspective view of a foot protection device, according to the third embodiment of the present invention, and FIG. 7 is a view to show the state where the foot protection device of FIG. 6 is worn on the foot. The drawings show the preferred embodiment of this invention.

According to the third embodiment of this invention, an instep protective cover 200 is attached to the exterior cover 100. The instep protective cover 200 functions to efficiently protect a player's instep, and has a size sufficient to cover the instep portion D of the exterior cover 100.

Further, an ankle protective cover 400 is coupled to the ankle portion C of the exterior cover 100 to efficiently protect the ankle. It is preferable that both the instep protective cover 200 and the ankle protective cover 400 be coupled to the exterior cover 100. Preferably, the instep protective cover 200 is spaced apart from the ankle protective cover 400 at a predetermined interval. That is, it is preferable that the protective covers 200 and 400 be placed on positions other than a folded portion E of the exterior cover 100.

The instep protective cover 200 and the ankle protective cover 400 are attached to an outer or inner surface of the exterior cover 100. Further, when the exterior cover 100 has a multiple-fold structure, the protective covers 200 and 400 may be inserted into the layers of the exterior cover 100. FIG. 6 shows the state where the instep and ankle protective covers 200 and 400 are attached to the outer surface of the exterior cover 100.

As shown in FIG. 6, it is preferable that the ankle protective cover 400 include a coupling part 420 and a flap 440 extended from the coupling part 420. In this case, the coupling part 420 is fixed to the exterior cover 100, but the flap 440 is not fixed to the exterior cover 100. Thus, the flap 440 can freely move relative to the exterior cover 100 to be folded along a fold line 430. The flap 440 covers the folded portion E provided between the instep portion D and the ankle portion C, thus protecting a joint between the instep and the ankle while allowing the smooth movement of the joint. In a detailed description, the coupling part 420 of the ankle protective cover 400 covers the ankle portion C to protect the player's ankle, and the flap 440 covers the folded portion E to protect the joint between the instep and the ankle. Further, the flap 440 is not fixed to the exterior cover 100, thus allowing the smooth folding motion of the folded portion E.

Further, a label L may be attached to a predetermined position of the protective covers 200 and 400 to designate a trademark, properties of a product, etc. The drawing shows the state where the label L is attached to a surface of the coupling part 420 of the ankle protective cover 400.

The instep and ankle protective covers 200 and 400 are made of natural or artificial leather, cloth or a synthetic resin sheet. It is preferable to use a synthetic resin sheet which is light in weight and has a cushioning effect. The instep and ankle protective covers 200 and 400 may be manufactured by one or more of leather, cloth, or synthetic resin sheet to have a single-fold structure or a multiple-fold structure. Further, the instep and ankle protective covers 200 and 400 may be attached to the exterior cover 100 through a sewing method or a bonding method by an adhesive. Preferably, only the edge of each of the protective covers 200 and 400 is sewn on the exterior cover 100, except a central portion of each of the protective covers 200 and 400, thus preventing the elasticity of the exterior cover 100 from being reduced.

FIG. 6 shows the preferred embodiment of the ankle securing means 150 employed in the present invention. As shown in FIG. 6, the ankle securing means 150 includes an elastic band 152 provided at an end of the ankle portion C, and a fastening means 154 provided on both surfaces of the elastic band 152. The elastic band 152 may be made of any material, as long as the material has elasticity. Further, the fastening means 154 may comprise a removable tape, a hook-loop system, or a Velcro fastener. In this case, the Velcro fastener is most preferred, because it has higher fastening force and is conveniently removably attached to a predetermined position. FIG. 6 shows an example where the Velcro fastener is used as the fastening means 154. As such, when the ankle securing means 150 includes the elastic band 152 and the fastening means 154, it is preferable that a cut part 60 be provided on the ankle portion D. The cut part 60 enlarges the opening 10, thus allowing the foot to be easily put in and taken out of the foot protection device.

Figure 8:
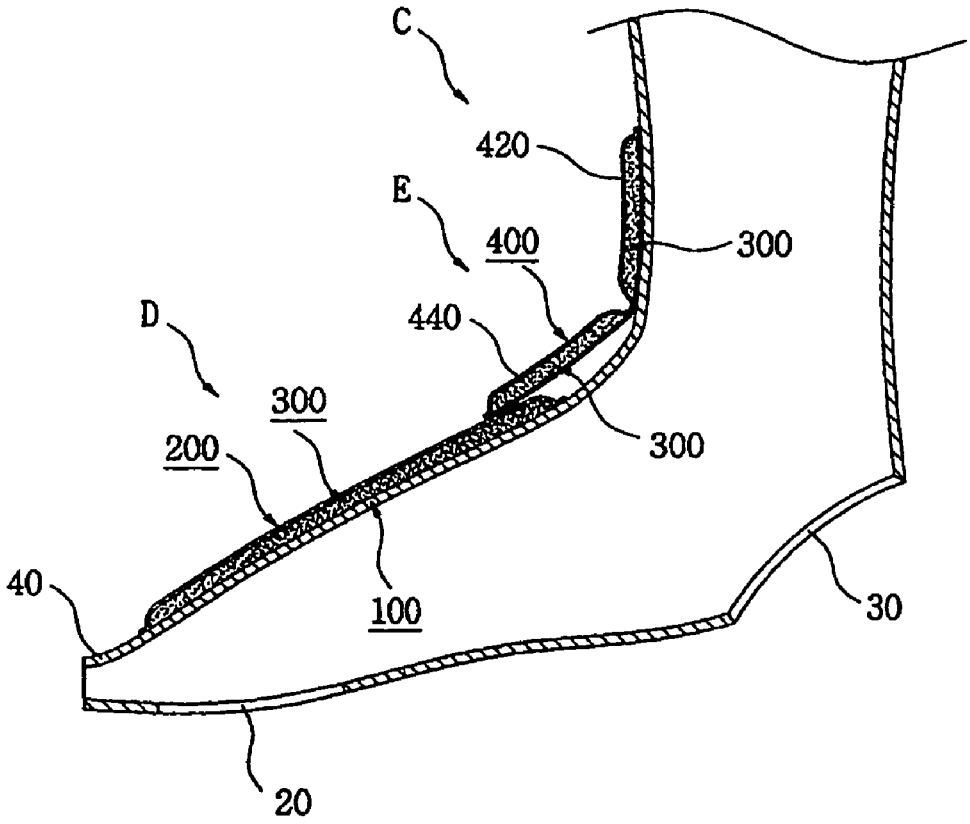
FIG. 8 is a sectional view of a foot protection device, according to the fourth embodiment of the present invention.

FIG. 8 is a sectional view of a foot protection device, according to the fourth embodiment of the present invention.

According to the fourth embodiment, when the protective covers 200 and 400 are attached to the outer surface of the exterior cover 100, a cushioning layer 300 may be provided between the exterior cover 100 and each of the protective covers 200 and 400. The cushioning layer 300 functions to protect the foot against a large shock. The cushioning layer 300 may be made of any material, as long as the material can absorb a shock. In a detailed description, the cushioning layer 300 may be made of a material which is highly resistant to a large shock, is light in weight, and has excellent shock absorption capacity. For example, cotton, soft cloth, compressible sponge, a sheet fabricated with compressed cotton, a sheet fabricated with shreds obtained by cutting cloth, etc. may be used as the material of the cushioning layer 300.

Further, when each of the instep and ankle protective covers 200 and 400 has a multiple-fold structure, the cushioning layer 300 may be inserted between layers of the structure. FIG. 8 shows an example where the ankle protective cover 400 has a two-fold structure, and the cushioning layer 300 is inserted between layers of the ankle protective cover 400. Further, air holes 310 (see, FIG. 10) may be bored in the cushioning layer 300 so that the cushioning layer 300 has air permeability. Similarly, air holes may be provided on the instep and ankle protective covers 200 and 400. Meanwhile, when the air hole are provided on the instep and ankle protective covers 200 and 400 as well as the cushioning layer 300, it is preferable that the air holes be aligned with each other so that the air holes of the cushioning layer 300 communicate with those of the instep and ankle protective covers 200 and 400, thus allowing air to pass through the cushioning layer 300 and the protective covers 200 and 400.

Figure 9:
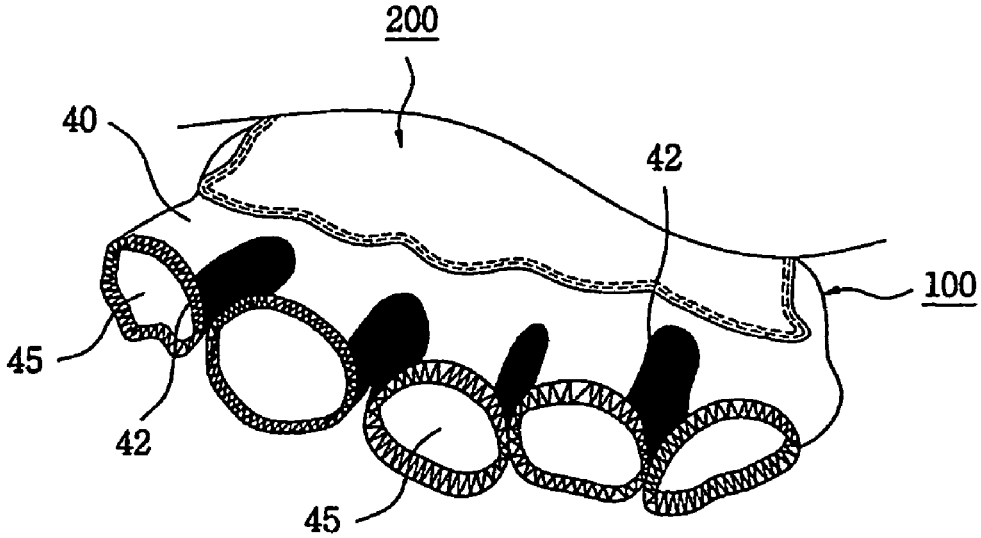
FIG. 9 is an enlarged perspective view to show a front part of a foot protection device, according to the fifth embodiment of the present invention.

FIG. 9 is an enlarged perspective view to show a front part of a foot protection device, according to the fifth embodiment of the present invention.

According to the fifth embodiment, the toe insert parts 40 are made of a material different from that of the exterior cover 100. Preferably, the toe insert parts 40 are made of a material having higher elasticity than the exterior cover 100. Particularly, sides 42 of the toe insert parts 40, which are provided between neighboring toe insert parts 40, comprise an elastic material different from that of the exterior cover 100. Preferably, the material of the sides 42 is softer and has higher elasticity, compared to the material of the exterior cover 100. In this case, the sides 42 are a portion of the toe insert parts 40 in which the toes are inserted, and concretely, the sides 42 are defined as portions between the first digit and the second digit, the second digit and the third digit, the third digit and the fourth digit, and the fourth digit and the fifth digit.

When the toe insert parts 40 are constructed as described above, the exterior cover 100 is in maximally close contact with the foot, thus allowing the toes to move more freely, and thereby affording a high level of power and quickness. More preferably, the sides 42 are made of a material with excellent sweat absorption capacity, because much sweat is exuded from between the toes.

Figure 10:
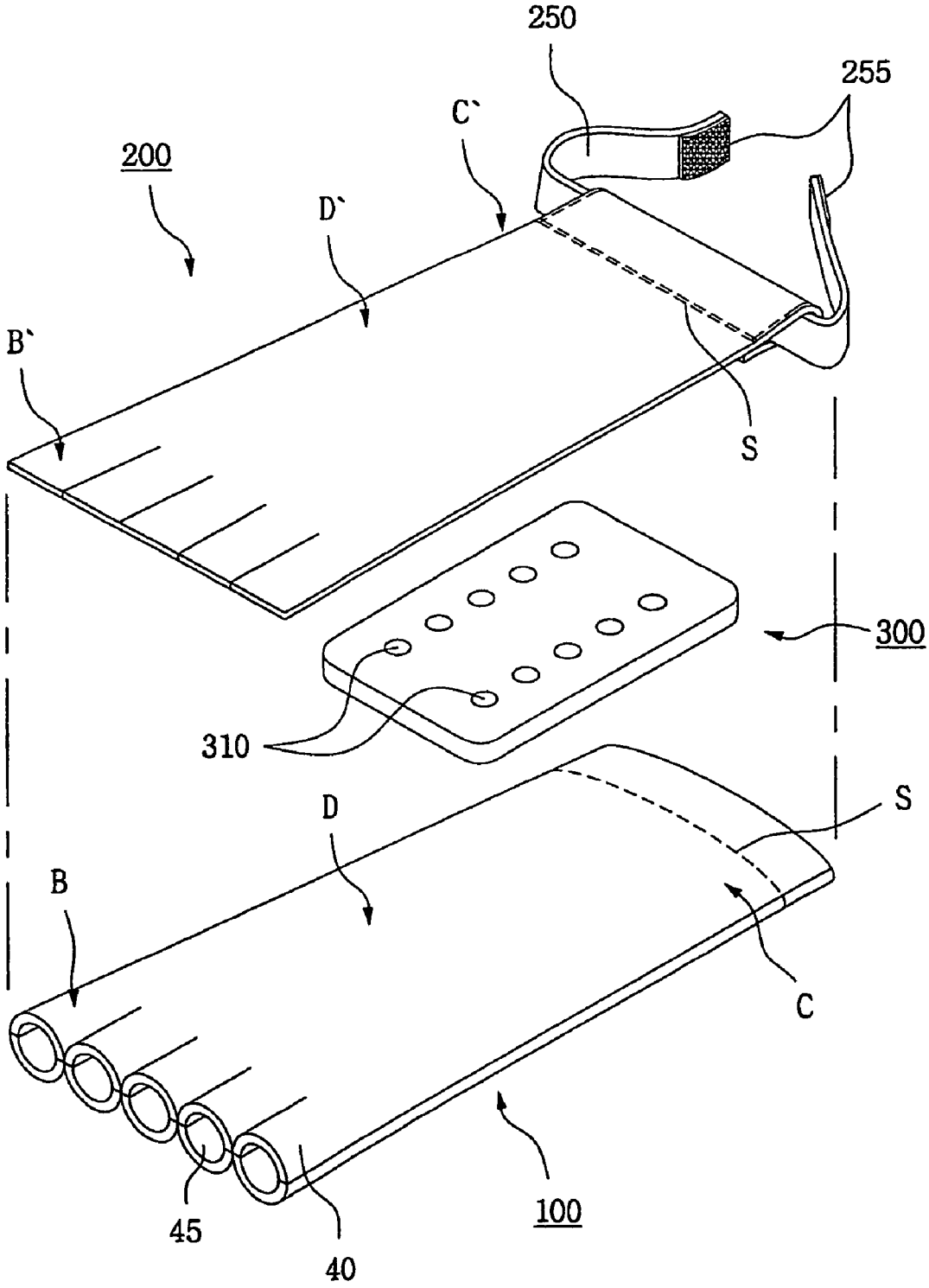
FIG. 10 is an exploded perspective view of a foot protection device, according to the sixth embodiment of the present invention.

FIG. 10 is an exploded perspective view of a foot protection device, according to the sixth embodiment of the present invention.

According to the sixth embodiment, the instep protective cover 200 may have a length extending to the toe portion B. Further, the instep protective cover 200 may have a length extending to cover the ankle portion C. In a detailed description, the instep protective cover 200 may have a size corresponding to an instep portion D' to cover the instep portion D of the exterior cover, and a toe portion B' and an ankle portion C' may be coupled to the instep portion D' of the instep protective cover 200. Alternatively, the instep protective cover 200 to be attached to the exterior cover 100 may have a size to cover all of the instep portion D', the toe portion B', and the ankle portion C'. As such, when the instep protective cover 200 has a length extending to the ankle portion C', an ankle securing band 250 is coupled to the ankle portion C' of the protective cover 200.

The ankle securing band 250 functions to firmly fasten the protective cover 200 around the wearer's ankle. Preferably, the ankle securing band may comprise an elastic band. The ankle securing band 250 is secured to the protective cover 200 through the following process. First, an end of the ankle portion C' of the protective cover 200 is folded to define a space, and subsequently, the ankle securing band passes through the space and is secured in the space by a sewing method. The reference numeral S of FIG. 10 denotes a sewing line. Further, a fastening means 255 is provided on both ends of the ankle securing band 250 so that the ankle securing band 250 is fastened while surrounding the wearer's foot.

The fastening means 255 may comprise a removable tape, a hook-loop system, or a Velcro fastener. In this case, the Velcro fastener is preferred. FIG. 10 shows an example where the Velcro fastener is used as the fastening means 255. FIG. 10 shows the state where the cushioning layer 300 having air holes 310 is placed between the exterior cover 100 and the protective cover 200.

INDUSTRIAL APPLICABILITY

As described above, the present invention provides a foot protection device, which protects a wearer's feet to prevent the wearer from being injured, and is in maximally close contact with the wearer's feet due to an elastic force of the foot protection device, and is light in weight, thus providing a sensation similar to that of a barefoot state. Further, areas of the wearer's sole contacting a ground surface are exposed to the outside through an anterior hole 20, a posterior hole 30, and toe holes 45, thus preventing the wearer from sliding on the ground surface. Especially, the toes are exposed to the outside, thus allowing free movement of the toes and thereby affording a high level of power and quickness. Further, elastic toe insert parts 40 come into close contact with the toes due to elasticity thereof, thus preventing injuries such as spraining of toes. Furthermore, the present invention further includes protective covers 200 and 400 and a cushioning layer 300, thus efficiently protecting the wearer's foot against a large shock.

Therefore, the foot protection device of the present invention is useful to protect the wearer's foot when training and playing fighting games, such as Taekwondo.

Moreover, the foot protection device can be applied to protect a player's foot when playing indoor games barefoot. Particularly, when the foot protection device comprises only an exterior cover, the foot protection device can be used to protect a player's foot when doing aerobics, floor exercises, or heavy gymnastics.

The invention claimed is:

1. A foot protection device, comprising:

an opening through which a foot is inserted;

an anterior hole and a posterior hole provided on a sole portion;

five toe insert parts with five toe holes provided on a toe portion, wherein each of the five toe holes is provided at an end of each of the five toe insert parts to expose toes;

ankle securing means provided at an end portion of an ankle portion;

an ankle protective cover attached to a top surface of the ankle portion, the ankle protective cover comprising a plurality of layers; and a cushioning layer provided between the plurality of layers of the ankle protective cover to absorb shock wherein each of the five toe insert parts extends toward each of the five toe holes to cover at least a part of each of five toes.

2. The foot protection device according to claim 1, further comprising:

an instep protective cover attached to a top surface of an instep portion of the exterior cover.

3. The foot protection device according to claim 2, further comprising:

a cushioning layer provided between the exterior cover and the instep protective cover in order to absorb shock.

4. The foot protection device according to claim 3, wherein air holes are provided on the cushioning layer.

5. The foot protection device according to claim 2, wherein the instep protective cover extends toward the toe portion.

6. The foot protection device according to claim 2, wherein the instep protective cover extends toward the toe portion and the ankle portion.

7. The foot protection device according to claim 1, wherein the ankle securing means comprises:

an elastic band provided at an end portion of the ankle portion; and fastening means provided on both surfaces of the elastic band.

8. The foot protection device according to claim 7, wherein the both surfaces on which the fastening means is provided fasten tightly when pressed together and are easily pulled apart by force.

9. The foot protection device according to claim 7, wherein a cut part is provided below the elastic band where the fastening means are provided to enlarge the opening when the foot is inserted into the opening.

10. The foot protection device according to claim 1, further comprising:

a cushioning layer provided between the exterior cover and the ankle protective cover in order to absorb shock.

11. The foot protection device according to claim 10, wherein the ankle protective cover comprises:

a coupling part fixed to the ankle portion of the exterior cover; and a flap extended from the coupling part to cover a portion between an instep portion and the ankle portion while the flap is not fixed to the exterior cover.

12. The foot protection device according to claim 1, wherein the ankle protective cover comprises:

a coupling part fixed to the ankle portion of the exterior cover; and a flap extended from the coupling part to cover a portion between an instep portion and the ankle portion while the flap is not fixed to the exterior cover.

13. The foot protection device according to claim 1, wherein sides of the five toe insert parts are made of an elastic material different from that of the exterior cover such that the sides have higher elasticity than the exterior cover.

14. The foot protection device according to claim 1, further comprising:

an upper piece having four first cut parts in between the five toe insert parts; and a lower piece having four second cut parts in between the five toe insert parts.

15. A protective footwear comprising:

an upper piece covering at least an instep portion of a foot and having first cut parts between toes;

a lower piece covering at least a sole portion of the foot and having second cut parts between toes;

an opening through which a foot is inserted;

an anterior hole and a posterior hole provided on the lower piece;

toe insert parts provided at each toe portion and having toe holes at ends of each of the toe insert parts to expose toes;

ankle securing means provided at an end of an ankle portion;

an ankle protective cover attached to a top surface of the ankle portion, the ankle protective cover comprising a plurality of layers; and a cushioning layer provided between the plurality of layers of the ankle protective cover to absorb shock wherein the upper piece and the lower piece are joined together into an exterior cover, and the first cut parts and the second cut parts are coupled into the toe insert parts, wherein each of the toe insert parts extends toward each of the toe holes to cover at least a part of each of five toes.

16. The protective footwear of claim 15, wherein the ankle securing means is connected to the exterior cover by sewing or adhesive bonding.

* * * * *